United States Patent [19]

Walhaug et al.

[11] Patent Number: 4,615,388

[45] Date of Patent: Oct. 7, 1986

[54] METHOD OF PRODUCING SUPERCRITICAL CARBON DIOXIDE FROM WELLS

[75] Inventors: Warren W. Walhaug, Houston; Aaron B. Neely, Tomball; Boyd B. Moore, Houston, all of Tex.

[73] Assignee: Shell Western E&P Inc., Houston, Tex.

[21] Appl. No.: 664,713

[22] Filed: Oct. 25, 1984

[51] Int. Cl.[4] ..... E21B 41/02; E21B 43/34; E21B 47/00; E21B 47/06

[52] U.S. Cl. ..... 166/250; 166/267; 166/371; 166/72; 166/106; 166/902

[58] Field of Search ..... 166/250, 244 C, 267, 166/310, 369-372, 68, 72, 106

[56] References Cited

U.S. PATENT DOCUMENTS

| | | | |
|---|---|---|---|
| 2,182,545 | 12/1939 | Pace | 166/369 X |
| 3,548,946 | 12/1970 | Engle | 166/106 X |
| 3,770,058 | 11/1973 | Smedley | 166/371 X |
| 4,235,289 | 11/1980 | Weeter | 166/68 X |
| 4,266,607 | 5/1981 | Halstead | 166/371 X |

*Primary Examiner*—George A. Suchfield

[57] ABSTRACT

This invention relates to a method of producing supercritical carbon dioxide from a well along with minor amounts of kill water having formation salts dissolved therein. The salt water is the result of killing the well with fresh water during pump installation and/or removal operations at which time the water enters the $CO_2$ producing formation and dissolves soluble salts which come into the well when the kill water returns to the well when it is put on production. Precipitation of salts carried by the kill water in the pump is prevented by continuously injecting water into the vicinity of the pump intake so as to dilute the returning kill water before it, or at least a portion of it, is vaporized into the water phase of the supercritical carbon dioxide. The volume of injected, substantially fresh water must be sufficient to handle the vaporization of water into the carbon dioxide in the pump as well as dilute the returning kill water so that the salts carried thereby remain in solution.

5 Claims, 3 Drawing Figures

FIG. 3 $CO_2$ WELL SUBMERSIBLE PUMP TEST RATE DECLINE AS A RESULT OF PRECIPATION OF SOLIDS

METHOD OF PRODUCING SUPERCRITICAL CARBON DIOXIDE FROM WELLS

This invention relates to a method of producing supercritical carbon dioxide from a well which has been drilled and/or completed with a water-base drilling, completion or kill fluid.

BACKGROUND OF THE INVENTION

Carbon dioxide has been used for many years in tertiary or enhanced recovery methods in oil fields in order to recover vast amounts of oil which would otherwise stay in the ground.

Since enormous amounts of carbon dioxide are needed to carry out a large carbon dioxide flood in an oil field, the best source for these large amounts of carbon dioxide appears to be the accumulation of carbon dioxide in reservoirs in the earth's formation. Large reservoirs of carbon dioxide have been developed and are being developed in Colorado and Texas, as well as other states.

In the 1940's, certain Colorado wells were developed wherein the production fluid was mainly carbon dioxide. As described in U.S. Pat. No. 2,729,291, the composition of the reservoir fluid was 90.3% $CO_2$, 4.8% $N_2$, 2.8% gaseous hydrocarbons, and 2.1% hydrocarbon oil. The phase proportions at wellhead conditions of 72° F. at 1090 psi were about 90% liquid by volume and 10% vapor. The reservoir conditions were at 2350 psi and about 145° F. at a depth of about 5100 feet in one well where the wellhead conditions were about 1050 psi at about 75° F. Thus, while the carbon dioxide was at supercritical conditions within the well, the conditions of the surface were just below the supercritical range. At the surface, the small amount of hydrocarbons was extracted from the carbon dioxide and the latter was then compressed and reinjected into the formation through another well.

In the late 1960's, several gas wells were drilled in Texas which produced natural gas contaminated with 18 to 53% of carbon dioxide. The carbon dioxide, which flowed from the wells as a gas, was separated from the natural gas and subsequently compressed to supercritical carbon dioxide at 2400 psi. The supercritical carbon dioxide was maintained at pressures between 1700 and 2400 psi which it was conveyed through a pipeline. This project was reviewed in an article entitled "Carbon Dioxide Pipeline is Major Engineering Achievement", Pipeline and Gas Journal, November 1971, pp. 44–58.

Recent U.S. Pat. Nos. 4,235,289 and 4,266,607 were issued, which were directed to a method for producing carbon dioxide in a single phase state at the surface from a subterranean formation through a well completed into the formation. The inventors were concerned with maintaining supercritical carbon dioxide produced into the well in a supercritical state throughout its passage up the well to the surface. To this end, a pump or compressor was installed in the supercritical carbon dioxide in the well to boost its pressure in amounts sufficient to overcome friction and hydrostatic head as it was produced up the well to a separator or pipeline at the surface.

SUMMARY OF THE INVENTION

While it may be possible to produce pure supercritical carbon dioxide from a well by operating a pump or compressor downhole in order to build up the pressure of the carbon dioxide to a value sufficient to pump it up the well and emerge in a supercritical condition, it has been found that this operation cannot be employed if a water-base drilling, completion or kill fluid has been used during the drilling or completion of the well. The water phase of such a fluid, say, a kill fluid, enters the production formation under pressure and dissolves or otherwise becomes commingled with soluble formation salts. Upon putting the well on production to produce carbon dioxide, the injected kill water containing salts dissolved therein will also be produced into the well. It has been found that carbon dioxide and minor amounts of a water-base kill fluid having formation salts dissolved therein cannot be produced together for long without the pump or compressor breaking down.

This is due to the fact that when supercritical carbon dioxide enters the bottom of the well at, say, 2000 lbs. psi at 165° F., it contains about 425 lbs. of water vapor per million cubic feet of carbon dioxide taken at standard conditions (S) of 14.7 psi at 60° F. However, when the supercritical carbon dioxide is run through the downhole compressor and the pressure is raised from 2000 psi to 3000 psi, additional water vapor can be picked up by the carbon dioxide until it becomes saturated with moisture at the higher pressure. In the example given, an additional 200 pounds of water per million cubic feet of carbon dioxide would be picked up.

Since small amounts of salt-ladened kill water are being returned to the well with the supercritical carbon dioxide, the additional water absorbed by the carbon dioxide is extracted from the water phase of the kill fluid. The result is that there is not enough water present in the fluids passing through the pump to maintain the salts in solution, thus causing the precipitation of the salts in the pump in the form of solid scale. As salts accumulate in the pump, the throughput of fluid through the pump or compressor is decreased resulting in decreased production from the well at the surface. Additionally, the mechanical failure of downhole compressor equipment has been attributed to the buildup of solid salts on the surface thereof causing unbalance of the shaft or other problems during its operation.

The method of the present invention obviates the problems previously encountered with production of supercritical carbon dioxide by means of a downhole compressor. This is done by analyzing the salts in the kill water returning to the well from the producing formation and adding sufficient water from the surface down through the well to the vicinity of the intake of the compressor so that the volume of salts that would otherwise drop out into the pump will be maintained in solution and discharged from the well together with the supercritical carbon dioxide even though the carbon dioxide picks up additional water vapor when it is compressed downhole.

The cost of replacing a downhole compressor being used to produce supercritical carbon dioxide may be about $100,000 or more. It is therefore an object of the present invention to provide a method of producing supercritical carbon dioxide together with returning kill water having salts dissolved therein without experiencing continued pump breakdowns caused by the drop-outs of salts in a downhole compressor used in the method.

Another object of the present invention is to ensure that an environment for the precipitation of salts carried by the kill water returning to the well is not reached in the pump. This is accomplished by continuously injecting water into the vicinity of the pump intake so as to dilute the returning kill water before it, or at least a portion of it, is vaporized into the water phase of the supercritical carbon dioxide. The volume of injected, substantially fresh water must be sufficient to handle the vaporization of water into the carbon dioxide in the pump as well as dilute the returning kill water so that the salts carried thereby remain in solution.

BRIEF DESCRIPTION OF THE DRAWING

These and other objects of the present invention will appear hereinafter from a consideration of the drawing and description.

FIG. 3 is a chart illustrating the decrease in production of supercritical carbon dioxide when the addition downhole of water is first terminated and then restarted again.

DESCRIPTION OF A PREFERRED EMBODIMENT

Figure 1:
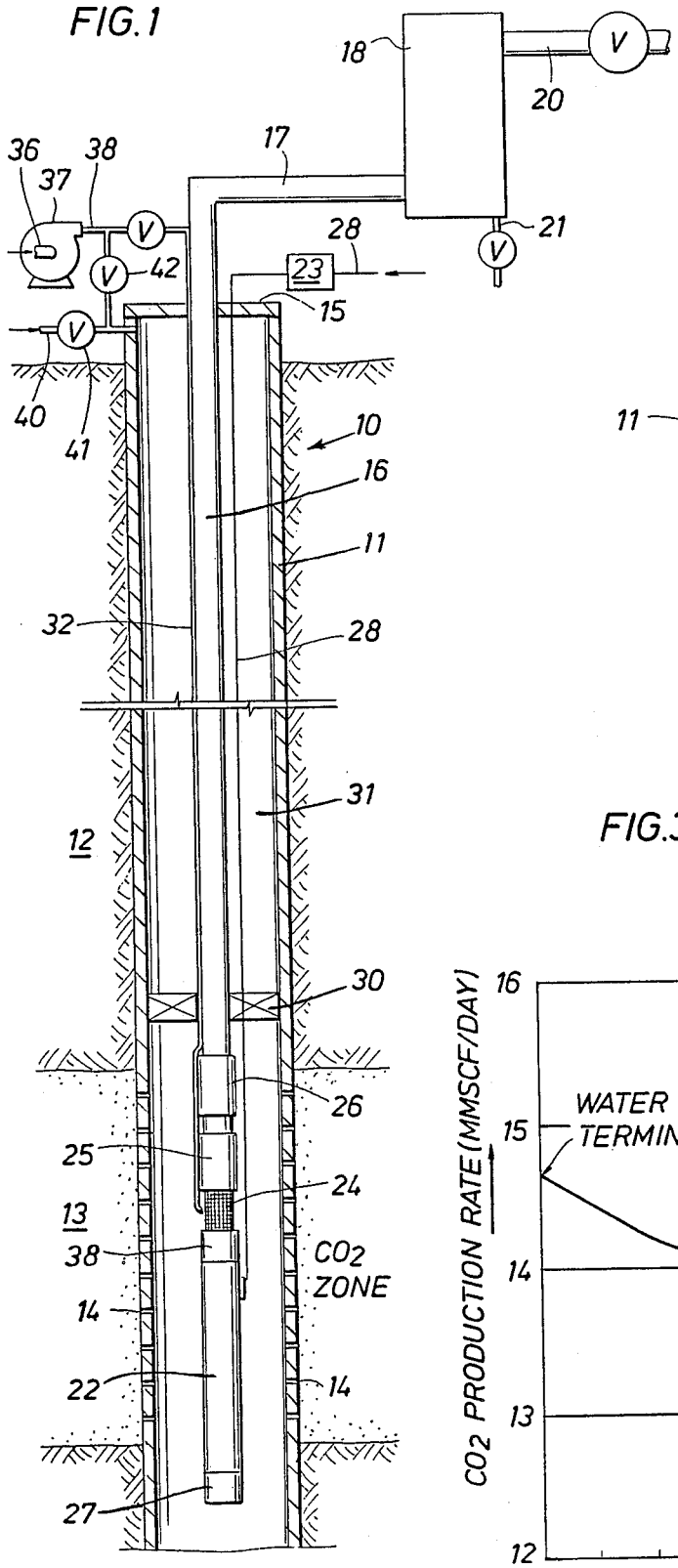
FIG. 1 is a diagramatic view taken in longitudinal cross-section of one form of apparatus shown as having been installed in a wellbore in order to practice the method of the present invention.

Referring to FIG. 1 of the drawing, a well 10 for producing carbon dioxide is illustrated as having been drilled to a total depth through an earth formation 12 having a zone 13 thereof containing a production fluid of supercritical carbon dioxide. A well casing 11 is illustrated as having been run into the well 10 and cemented therein in a manner well known to the art to form an effective seal between the casing 11 and the wall of the borehole 10. Although only a single string of casing 11 is shown for illustration purposes, it is recognized that a well may be drilled and provided with several concentric strings of casing. Since the present invention is only concerned with the casing and production strings in the vicinity of the production zone 13 of the well, only one string of casing 11 will be considered in this description. The casing 11 is provided with a series of perforations 14 preferably below the compressor and in the interval opposite the carbon dioxide production zone, unless there is an open hole completion with the casing cemented above the carbon dioxide zone.

The well casing 11 is closed by a suitable wellhead closure or production wellhead of any suitable form well known to the art. In FIG. 1, the wellhead closure is represented by plate 15 which closes the top of the casing 11 in a fluidtight manner. Extending through the wellhead closure 15 is a production tubing or pipe string 16, which is provided to convey the production fluid from the production zone 13 to the surface. The top of the production tubing 16 is connected to a pipeline 17 running to a separator 18 where the water component of the well production fluid may be separated from the supercritical carbon dioxide. Any suitable type of separator 18 well known to the art may be employed to separate the carbon dioxide from the water. Since the construction of the separator does not form part of the present invention, the separator will not be described in greater detail at this point. Obviously, the separator would be provided with a pair of discharge conduits 20 and 21 for transferring carbon dioxide and separated water, respectively, from the separator.

Suspended from the lower end of the production tubing 16 is a suitable pump or compressor for raising the pressure of the well fluid within the well prior to pumping it up the well to the surface. In FIG. 1, a downhole compressor of the submersible type is illustrated as comprising a submersible motor 22, a motor seal section 38, a pump intake 24, and one or more compressor sections 25 and 26, which operate in tandem. Each compressor section unit 25 and 26 may have up to 200 or more stages. Additionally, the downhole pump may be provided with a pressure and temperature sensing unit 27, if desired. The electrical downhole pump is driven by power supplied through a suitable cable 28 extending from the surface to the pump motor 22. A variable-speed drive 23 may be operatively connected to the motor 22 through cable 28.

In general, it is preferred to utilize an annular packer 30, which is mounted on and carried by the production tubing 16 above the pump, if corrosion problems are anticipated. The annular packer 30 is used to close the annulus 31 formed between the casing string 11 and the production tubing 16. When the well is completed, prior to putting it on production, the packer 30 is mounted on the production tubing string 16 above the pump and run into the well 10, which is controlled at the time, by a fluid such as oil or water, filling the casing 11 to compensate for the production fluid attempting to come into the bottom of the well. If it is desired that the carbon dioxide production zone 13 be uncontaminated by water, a diesel oil could be used as the kill fluid. If some formation water is coming into the bottom of the well along with the carbon dioxide, water may be used as a kill fluid.

There are many commercially available annular well packers of the retrievable type which are either hydraulically or mechanically set in a retractable manner. A retractable packer is necessary in order to pull the tubing string 16 from the well together with the packer and pump in the event of failure of either the packer or pump. One example of a suitable packer is a twin seal submersible pump packer manufactured by Brown Oil Tools, Inc., Houston, Tex. This type of a packer allows a cable 28 to run down along the tubing string 16 and pass through the packer 30 in a fluidtight manner.

Figure 2:
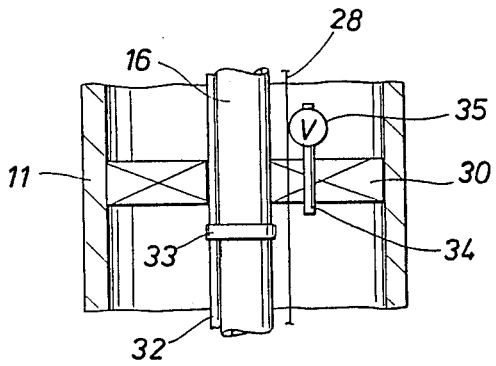
FIG. 2 is a view taken in enlarged detail diagrammatically illustrating another form of apparatus to be used in a well with the method of the present invention.
Figure 2:
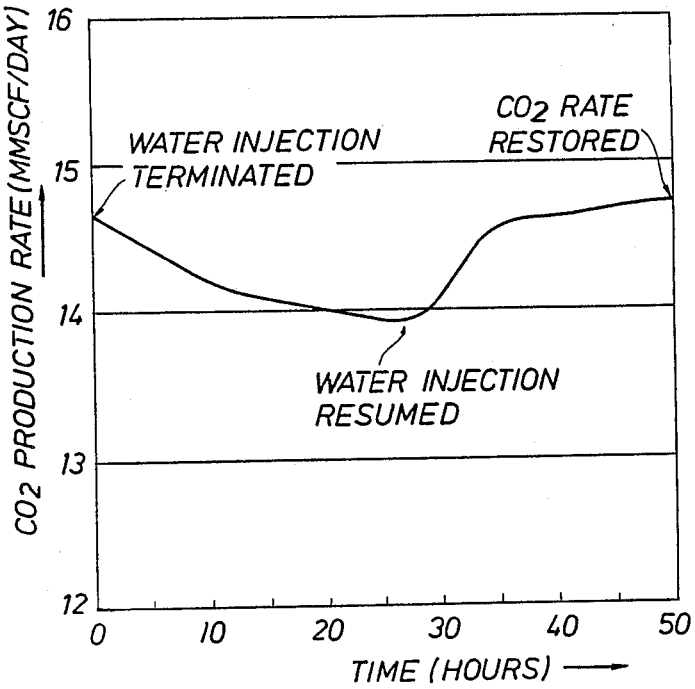

In order to carry out the primary purpose of the present invention, the above described apparatus is provided with suitable conduit means in the form of, say, one-half inch stainless steel tubing, which extends from the surface of the well down along the production tubing string 16, through the packer 30, and thence down to terminate below the packer 30, preferably in the vicinity of the pump intake 24. This tubing 32 is preferably secured to the outside of the production string 16 in any suitable manner, as by stainless steel straps 33 as shown in FIG. 2. The tubing 32 passes through the annular packer 30 in a fluidtight manner.

Also illustrated in FIG. 2 in a schematical manner is a vertical conduit 34, which may be closed by suitable pressure responsive or hydraulically operated valve means. This is an alternative arrangement of a vertical conduit by which fresh water or a substantially undersaturated salt-free water may be introduced to the space below the annular packer 30 in order to be commingled with the carbon dioxide and the returning kill water coming in from the production zone. Obviously, only one of the conduits, either 34 or 32, need be used at a time under normal conditions.

As illustrated in FIG. 1, it is a primary object of the present invention to provide a source of fresh water or substantially undersaturated salt-free water which is piped through conduit 36 to a pump 37, which discharges the fluid into pipe 38 which connects to the small diameter tubing 32, running down the well to terminate in the vicinity of the pump intake 24. If desired, a second line 40 into the top of the well normally closed by valves 41 and 42 is provided whereby a corrosion inhibitor may be added periodically or from time to time into the upper end of the annular space 31 within the well casing 11. Alternatively, fresh water or substantially salt-free water could be added through line 40 and valve 41 into the annulus 31, down the annulus, and through valve 35 and conduit 34 to a point below the annular packer so as to combine or commingle with the carbon dioxide therein.

The method of the present invention is concerned with producing from a well a single-phase well fluid comprising a predominant amount of supercritical carbon dioxide and a minor amount of water having formation salts dissolved therein. The water coming into the well may be water from an aqueous drilling, production or kill fluid used to drill or kill the well, where some of the drilling or kill fluid has been forced into the formation. If water was used in a drilling or a kill fluid, during the time the water remains in the $CO_2$ producing formation and commingles with any connate water therein, and during its return therefrom into the well, the water dissolves or picks up dissolved formation salts such as sodium chloride, calcium carbonate, magnesium carbonate, and calcium sulfate, which salts are generally present in the formation. Further, the present invention is concerned with carbon dioxide producing wells, which also have returning to the well small amounts of injected water having formation salts dissolved therein, or with oil wells producing a predominant amount of oil and a minor amount of water having dissolved salts therein together with a high volume gas flow with a high cut of carbon dioxide. The problem is that when only small volumes of water and dissolved salts come into the well with the carbon dioxide, some of the salts carried by the water settle out from the water when the carbon dioxide and water are compressed in the well by a downhole pump to a value sufficient to cause the carbon dioxide to absorb sufficient water from the well fluid.

Thus, on flowing the carbon dioxide and any returning salt water through the downhole well pump and compressing it, the supercritical carbon dioxide picks up some of the water phase as water vapor with the results that a precipitation of solids in the form of salts in the pump occurs. For example, it may be calculated that in one well flowing 15,000,000 standard cubic feet of supercritical carbon dioxide per day could have as much as 200 or more pounds of salt per day in the pump or compressor.

It is preferred that each well be individually analyzed in order to determine the type, severity, and critical occurrence of the precipitation of salts in a carbon dioxide environment. The calculation of the carbon dioxide affinity for water vapor in a carbon dioxide and saline water environment is extremely important in order to determine the carrying capacity for the various salts present in solution at declining water rates. In addition, factors such as pressure, temperature, gas composition, and water rate must be considered. In a typical analysis, the composition of the gas may have 98.0% carbon dioxide, 1.5% nitrogen, and 0.5% methane.

Water production into the well may be determined by a total water measurement taken at the separator 18 (FIG. 1). In accordance with the teachings of the present invention, the total water entering the well consists of the water phase of the returning drilling or kill fluid having soluble salts dissolved therein, together with the water vapor saturating the supercritical carbon dioxide at bottom hole pressure. Water rate inflows into the well and the type and amount of salts carried thereby can be determined by metering, sampling, and analyzing samples taken from the separator. For a well killed with water, one would carry out the steps of continuing to analyze the separated water at the surface until the water-soluble salt content thereof drops below a selected minimum value, and then discontinuing the addition of substantially salt-free water into the well through said water-injection conduit means.

Also to be taken into consideration is the type of pumping equipment being used to determine the increase in pressure and temperature of the supercritical carbon dioxide as it passes through the pump. The solubility of water in carbon dioxide gas increases with increased pressure and temperature, thus decreasing the free water available to dissolve sodium chloride, carbonates, and the sulfates. In one well, a critical area developed between 3 and 1.15 bbls/MMSCF total water. The precipitation of solids was found to be quite active in this area resulting in considerable scaling in the pump. In a well with a discharge pump pressure of 3,000 psi and a temperature 195° F., total vaporization of water to the carbon dioxide vapor phase occurred at approximately 1.8 bbls/MMSCF. Sodium chloride became supersaturated just prior to total vaporization at 1.88 bbls/MMSCF total water. Calcium sulfate began precipitating out when there was as little as approximately 2.75 bbls/MMSCF total water present.

In a certain saline environment, carbon dioxide contains about 1.15 bbls/MMSCF vaporized water for reservoir conditions of 2500 psi and 165° F. It can be expected that solids would not be carried uphole in a vapor state when free water is not available. The presence of sodium chloride has the effect of reducing the vaporization of water into the carbon dioxide. With the absence of a saline environment, carbon dioxide has an affinity for about 1.5 bbls/MMSCF water at these same reservoir conditions. As long as free water is available, the potential problem of oversaturated solution will also exist below, say, 3 barrels of water/MMSCF for the conditions given.

Once the total water rate returning from the formation in the well has dropped below 3 bbls/MMSCF, a noticeable decline in surface solutes occurs. This indicates that the precipitation of the salts as solids in the pump is taking place. Substantial buildup of scale and loss in the efficiency of the pump's performance was confirmed by alternative tests.

Whereas early pump tests had been unsuccessful, subsequent tests showed no carbon dioxide rate decline being discharged from the pump as long as sufficient additional substantially salt-free water was added from the surface down the one-half inch tubing 32 to be discharged in the vicinity of the pump intake 24. This test indicated that the fresh water injection of approximately 50 barrels per day into a well producing approximately 15 MMSCF/D of supercritical carbon dioxide was successful in diluting the solutes at the pump intake, thus eliminating the precipitation of salts in the pump or compressor.

Referring to FIG. 3 of the drawing, a test of the water injection system is illustrated wherein the injection of salt-free water by pump 37 (FIG. 1) was stopped for a 24-hour period. An almost immediate carbon dioxide rate decline in production was observed due to the accumulation of solids in the pump. The rate continued to decline without the water injection in operation. Upon resuming the injection of water in accordance with the present invention, an immediate response in the carbon dioxide rate discharge at the surface was experienced. It is considered that during the initial water flush the more soluble solids in the pump, such as sodium chloride, were washed out of the pump. This was confirmed by the high concentration of sodium chloride which showed up in the water samples taken at the separator 18 soon after the water injection was resumed. The production rate of carbon dioxide from the well was eventually returned to its full capacity upon cleanup of the less soluble solids, such as calcium carbonate and calcium sulfate, from the pump.

To ensure that an environment for the precipitation of solids in the pump is not reached, in accordance with the present invention an injection of water can be continuously introduced into the well below the annular packer 30, and preferably in the vicinity of the pump intake 24, to dilute the kill water coming into the well before some or all of it is vaporized to the carbon dioxide vapor phase. The volume of injected fresh water or substantially salt-free water must necessarily be sufficient to handle the vaporization of water into the carbon dioxide in the pump and dilute the returning kill water to maintain the formation salts dissolved therein. No precise amount of water to be added to the well can be set forth as a general rule, as each well may vary with regard to pressure, temperature, flow rates, analysis of the gas, and analysis and quantity of the soluble salts carried by the returning kill water flowing into the well.

Thus, while producing a single phase well fluid comprising supercritical carbon dioxide with a minor amount of water having salts dissolved therein from a well that has been killed by pumping kill water therein, the present method provides for adding to the well fluid in the vicinity of the pump an amount of substantially salt-free water sufficient to maintain any salts picked up and/or carried by the kill water in solution as the kill water is discharged from the pump with water-saturated supercritical carbon dioxide at a pressure substantially higher than when it entered the well. By this method, the supercritical carbon dioxide and kill water carrying the salts therein are produced to the surface as a single-phase fluid to a separator at the surface.

In carrying out the present method, a high-pressure well producing a predominant quantity of carbon dioxide may be drilled in any manner well known to the art, as by use of a water-base drilling fluid to control well pressures during drilling. After drilling operations are completed, the drilling fluid may be circulated out of the well and replaced with water which serves as a kill fluid for containing the well pressures.

The pump or compressor made up of elements 22, 24, 25, 26 and 27 are then lowered into the well at the lower end of the production pipe string 16, together with cable 28 and the small-diameter tubing 32 which are strapped to the pipe string 16. The annular packer 30 is run at the same on pipe string 16 in an inoperative position. After the pipe string 16 has been hung from the wellhead and the wellhead closed, the packer 30 is actuated or set in a manner well known to the art to close the annular space 31.

The well is put on production by energizing the compressor motor 22 through power cable 28. Since the well is filled with kill water at the start-up of pumping operations, a suitable controller or variable speed drive 23 may be employed so that the motor 22 and the compressor stages forming the pump means are operated at a selected reduced speed to protect the motor when the predominantly heavier kill fluid is being pumped out of the well. This may take from a fraction of an hour to several hours depending on the depth of the well and the capacity of the pump means and the piping operatively connected thereto.

After the well has been emptied of kill fluid below the packer, the compressor speed may be increased to its normal operating speed. The kill fluid remaining in the formation returns to the well at a relatively slow rate and now has salts dissolved therein. It may take up to six months or more for all the kill water to return to the well and be produced therefrom. Since the amount of returning kill water is small in volume, some of it is picked up as water vapor by the carbon dioxide as the mixture is compressed to a higher pressure by the pump means. This action causes salts normally carried by the water to drop out in, or otherwise form scale in, the pump means or compressor. This situation may be noted or monitored at the surface by a drop in the fluid output from the well. Additional water is then added to the well below the packer 30 and preferably in the vicinity of the pump intake 24 so as to provide sufficient water to keep the salts in solution as they pass through the pump.

In the event that a compressor or pump has to be pulled from the well for repairs, the well would again be killed by pumping water kill fluid down the pipe string 16 and through the pump or compressor to fill the space in the well below the packer and enter the producing formation 13. The hydrostatic head of fluid in the well would contain the carbon dioxide within the formation after the packer 30 is released and pulled with the pipe string 16 and the pump to the surface.

When a new pump or compressor is to be installed in the killed well, the steps described hereinabove, with regard to first putting a well on production after it was drilled, would be repeated here. That is, a pump or compressor would be run on a pipe string together with a power cable and a small diameter tubing for continuously or periodically adding more water in the vicinity of the pump intake starting at a selected time after the packer had been set and the pump started. This would prevent the deposition of salts in the pump when the carbon dioxide picked up more water vapor as it was being compressed.

We claim as our invention:

1. A method of producing supercritical carbon dioxide through a cased well from a subterranean formation having water-soluble salts therein, said method comprising killing the well with a volume of water-base kill fluid to contain the supercritical carbon dioxide within its producing formation whereby some of the salts in said formation become dissolved in the water of the kill fluid, installing an annular packer on a production tubing string having pump means operatively connected to the lower end thereof, said pump means operatively connected to the lower end thereof, said pump means having suction and discharge means, lowering said tubing string, packer and pump means through the kill fluid in the well until said pump means is located at a pre-selected depth, setting the annular packer in a fluidtight manner between said tubing string and said casing, providing water-injection conduit means outside said tubing string between the surface at the top of the well to a discharge point in the vicinity of the suction means of the pump means while by-passing said annular packer, adding to the well fluid below said packer through said water injection conduit means an amount of substantially salt-free water sufficient to maintain in solution any dissolved formation salts in the kill fluid, which come from the formation back into the well with the kill fluid, as the carbon dioxide component of the well fluid is compressed by the pump means, and pumping from the well the combined fluids comprising carbon dioxide together with kill fluid and added water and the dissolved salts carried thereby to prevent salts from solidifying in said pump means, said pumping being carried out under conditions to produce carbon dioxide at the surface at a pressure greater than the critical pressure of produced carbon dioxide.

2. The method of claim 1 including the step of operating the pump means at a selected reduced speed during the start-up of the pumping operation for the interval wherein predominantly kill fluid is being removed from the well by the pump means.

3. The method of claim 2 including the step of increasing the speed of the pumping operation when the major portion of the kill fluid has passed through the pump means and predominantly carbon dioxide is entering the pump.

4. The method of claim 1 including the steps of passing the combined fluids emerging from the top of the well to separator means to separate at least the water from the carbon dioxide, and analyzing the water for water-soluble formation salts picked up by the kill fluid from the earth formation.

5. The method of claim 4 including the steps of continuing to analyze the separated water at the surface until the water-soluble salt content thereof drops below a selected minimum value, and then discontinuing the addition of substantially salt-free water into the well through said water-injection conduit means.

* * * * *